US008733600B2

(12) United States Patent
Pritchard

(10) Patent No.: US 8,733,600 B2
(45) Date of Patent: May 27, 2014

(54) DISPENSING CLOSURE SYSTEM, FLEXIBLE PACKAGE WITH A DISPENSING CLOSURE SYSTEM, METHOD OF FILLING THE SAME BY A FORM-FILL-SEAL MACHINE AND METHOD OF DISPENSING A FLOWABLE PRODUCT FROM SAID PACKAGE

(75) Inventor: Barry Pritchard, Nazareth, PA (US)

(73) Assignee: Fres-co System USA, Inc., Telford, PA (US)

( * ) Notice: Subject to any disclaimer, the term of this patent is extended or adjusted under 35 U.S.C. 154(b) by 58 days.

(21) Appl. No.: 13/349,242

(22) Filed: Jan. 12, 2012

(65) Prior Publication Data

US 2012/0187158 A1 Jul. 26, 2012

Related U.S. Application Data

(60) Provisional application No. 61/434,633, filed on Jan. 20, 2011.

(51) Int. Cl.
*B65D 25/40* (2006.01)

(52) U.S. Cl.
USPC ..... 222/501; 222/494; 222/541.9; 53/452

(58) Field of Classification Search
USPC ..... 222/494, 541.9, 81, 105, 501; 53/452, 53/478, 310, 133.1–133.3, 133.8, 134.1
See application file for complete search history.

(56) References Cited

U.S. PATENT DOCUMENTS 4,682,702 A * 7/1987 Gach ..... 222/541.9
5,176,300 A * 1/1993 Kishikawa et al. ..... 222/541.5
5,531,363 A * 7/1996 Gross et al. ..... 222/494
5,842,618 A * 12/1998 Julemont et al. ..... 222/490
6,086,523 A * 7/2000 Adams et al. ..... 493/87
6,129,228 A * 10/2000 Adams et al. ..... 215/45
6,273,296 B1 * 8/2001 Brown ..... 222/92
6,378,730 B1 * 4/2002 Reddy et al. ..... 222/83
6,568,563 B2 * 5/2003 Ma et al. ..... 222/83

(Continued)

FOREIGN PATENT DOCUMENTS

EP 0734960 A2 10/1996
JP 11100050 A1 4/1999
WO 9511172 4/1995

OTHER PUBLICATIONS

European Search Report for EP 12 15 1869 completed Apr. 13, 2012.

*Primary Examiner* — Paul R Durand
*Assistant Examiner* — Donnell Long
(74) *Attorney, Agent, or Firm* — Caesar, Rivise, Bernstein, Cohen & Pokotilow, Ltd.

(57) ABSTRACT

A dispensing closure system, a package including the same, a method of making the package on a form-fill-seal machine and a method of dispensing flowable products from the package are disclosed. The package includes an openable port in a wall in communication with the package's interior. The closure system comprises a fitment having a hollow body member, a resilient valve, and retainer assembly. The body member is secured to the package's wall and encircles the openable port. The valve is held in the body member by the retainer assembly, which comprises a retaining ring and a cap integrally connected to each other by a frangible connection. The cap includes a handle which may be pulled to break the frangible connection to remove the cap and thereby expose the valve for a dispensing probe to be extended therethrough to dispense the product.

20 Claims, 3 Drawing Sheets

(56) References Cited

U.S. PATENT DOCUMENTS

| | | | | |
|---|---|---|---|---|
| 6,616,016 | B2 | 9/2003 | Hicks et al. | |
| 6,672,487 | B1 | 1/2004 | Lohrman | |
| 6,851,586 | B2 * | 2/2005 | Odet | 222/541.9 |
| 6,883,689 | B2 * | 4/2005 | Odet | 222/541.9 |
| 7,357,277 | B2 | 4/2008 | Verespej et al. | |
| 7,387,220 | B2 | 6/2008 | Verespej et al. | |
| 7,413,097 | B1 * | 8/2008 | Adams | 220/268 |
| 7,559,432 | B2 * | 7/2009 | Mavin et al. | 220/258.2 |
| 7,721,901 | B1 * | 5/2010 | Von Spreckelsen et al. | 215/232 |
| 8,066,141 | B2 * | 11/2011 | Casale et al. | 220/270 |
| 8,397,958 | B2 * | 3/2013 | Smith et al. | 222/494 |
| 2001/0011649 | A1 * | 8/2001 | Fujie et al. | 215/256 |
| 2001/0015355 | A1 * | 8/2001 | Adams et al. | 220/258 |
| 2003/0071042 | A1 * | 4/2003 | Adams | 220/258.2 |
| 2003/0071089 | A1 * | 4/2003 | Ma et al. | 222/541.9 |
| 2004/0074396 | A1 * | 4/2004 | Murray | 99/275 |
| 2006/0249536 | A1 | 11/2006 | Hartman et al. | |
| 2008/0210712 | A1 * | 9/2008 | Rault et al. | 222/153.14 |
| 2009/0212078 | A1 | 8/2009 | Gaus | |
| 2010/0133273 | A1 | 6/2010 | Thurman et al. | |
| 2010/0294812 | A1 * | 11/2010 | Lohrman et al. | 222/541.9 |

* cited by examiner

DISPENSING CLOSURE SYSTEM, FLEXIBLE PACKAGE WITH A DISPENSING CLOSURE SYSTEM, METHOD OF FILLING THE SAME BY A FORM-FILL-SEAL MACHINE AND METHOD OF DISPENSING A FLOWABLE PRODUCT FROM SAID PACKAGE

CROSS-REFERENCE TO RELATED APPLICATIONS

This application claims priority from Provisional Application Ser. No. 61/434,633, filed on Jan. 20, 2011, entitled Dispensing Closure System, Flexible Package with a Dispensing Closure System, Method of Filling the Same by a Form-Fill-Seal Machine and Method of Dispensing a Flowable Product from said Package, which application is assigned to the same assignee as this application and whose disclosure is incorporated by reference herein.

BACKGROUND OF THE INVENTION

This invention relates generally to flexible packages for flowable materials and more particularly to fitments, in the form of closure systems, for such packages, packages including such fitments, method of filling such packages on a form-fill-seal machine and methods of dispensing flowable materials from such packages.

"Bag-in Box" Technology for filling larger pouches and bags with liquid products has existed for many years. This technology has evolved over the years to allow many products to be filled in a variety of bag sizes and formats. However, the main requirement of the Bag-in-Box system is a fitment (spout assembly) which is used primarily as an entryway or port to allow a passageway for products to be forced into the package. To accomplish this, the fitment assemblies must be large enough in size the allow products to be pumped through them at a rate which allows for meaningful production rates. In the largest majority of applications, the fitment assembly's sole purpose is to be this conduit for filling.

Over the years, applications for bags and pouches filled with liquid products have evolved to meet demand in the "dispensing" industry whereby liquid products such as diary creamer, liquid yogurt, beverages and even industrial chemicals etc., are first filled into a pouch or bags with a fitment and then after distribution are—at the point of use—connected via a specially designed fitment to a dispensing machine or device.

One major example of such pouches in commercial use is found in the soft drink beverage syrup industry where large 2.5 gallon (and even five gallon bags) are filled through the spout of a specially designed fitment assembly which also contains the necessary features to allow it to be connected to a pump-out system which draws the proper amount of syrup from the package to create a soft drink beverage.

The Bag-In-Box industry has further evolved its offering to include systems which can fill aseptic products. This is accomplished through the use of properly designed filling equipment which can be rendered commercially sterile under the FDA guidelines within CFR113 and CFR114. For such applications fitment assemblies are utilized which incorporate a flanged tubular base (spout) and a cap assembly to close off the base. The fitment assembly is heat sealed to a pre-made bag such that the seal between the bag and fitment assembly creates a hermetic barrier to the ambient atmosphere. The entire bag unit then is exposed to gamma radiation (e.g., cobalt 60) to render it commercially sterile on all of its internal surfaces. Bag filling is then accomplished on the automated equipment by re-sterilizing the exterior surfaces of the fitment assembly and then inserting the fitment assembly into a sterile chamber integral to the filling machine. Inside the sterile chamber a gripper pulls a sealing cap portion of the cap assembly off of the spout and then inserts a filling valve into the spout. The filling valve is opened and product dispensed into the bag. When the proper fill volume is reached, the filling valve is removed from the spout and the sealing cap is reinserted onto the spout, capping or "corking" the spout closed. The filled bag is then released to the next steps of production.

Examples of prior art packages making use of the aforementioned technology are found in U.S. Pat. No. 7,357,277 (Verespej et al.), U.S. Pat. No. 7,387,220 (Verespej et al.), and U.S. Published Applications 2006/0249536 (Hartman et al.), 2009/0212078 (Gaus), and 2010/0133273 (Thurman et al.).

Recently, Fres-co System USA, Inc., the assignee of this invention, has developed a Bag-In-Box fitment assembly known as the "FRES-CAP"™ assembly, which is shown in FIG. 1. The "FRES-CAP"™ assembly is designated by the reference number 1 in that figure is particularly suited for aseptic use. In particular, the FRES-CAP"™ assembly incorporates an integral molded silicone slit valve 2, a retaining ring 3 and a removable cover 4. The slit valve is constructed in accordance with the teachings in the aforementioned U.S. Patent Applications 2006/0249536, and 2009/0212078, and in U.S. Pat. No. 6,616,016. The FRES-CAP"™ assembly 1 is inserted onto a mating gland or spout 5 (such as described above) and the entire assembly is heat sealed to the wall 6 of a flexible bag, e.g., a two gallon bag. The bags are then irradiated and sent to customers for filling in the manner described above.

The FRES-CAP"™ assembly is designed to not only allow for filling of the pre-made bags under aseptic conditions, but also to mate up with equipment at a user's location, e.g., a fast food restaurant. To accomplish this, the FRES-CAP"™ assembly (and other assemblies like it) include a passage through the cap body which allows for insertion and retention of the slit valve 2. The slit valve contains as a feature of its manufacture a series of cuts through its face which allow it to be penetrated by a dispensing probe (e.g., a tubular member, like that shown in FIG. 7) which provides access the flowable product inside the bag and allows it to be pumped out. The cuts or slits in the valve are arranged in a pattern which forms a circumferential seal around the probe, preventing leakage.

The removable cover 4 is disposed above the molded silicone slit valve and includes a post or pillar 6 which extends downward from its undersurface to a point immediately adjacent the portion of the valve 2 containing the slits. This post provides support to area of the molded silicone slit valve to prevent or reduce the incidence of the slit valve being deformed after sterile product has been filled into the package. Deformation of the slit valve after filling would cause the contents of the bag to be allowed to pass through the slits or cuts, thus creating a breach of the sterile barrier within the fitment assembly.

As will be appreciated by those skilled in the art that while Bag-In-Box technology is successful and suitable for its intended purposes. It nevertheless leaves much to be desired. In particular, it does not lend itself to high filling rates given that the flowable product introduced into the package must enter it through the spout. In aseptic applications, Bag-in-Box systems are even slower, given the exterior of the fitment assembly must be sterilized before the cap can be removed for filling. Most commercial sterilization systems for Bag-in-Box fitments require exposure to atmospheric steam (210 degrees F.) for about 10 seconds which yields cycle rates of approximately 6 bags per minute.

Thus, a need exists for a closure system which can be used on a flexible package produced and filled on a form-fill-seal machine so that the filling of the packages does not have to occur through the fitment. That fitment should be arranged to be opened when desired to accommodate a conventional dispensing probe to effect the dispensing of the package's contents. Moreover, the production and filling of the flexible package and the securement of the fitment to the package should be able to be accomplished under aseptic conditions. The subject invention provides a closure assembly in the form of a fitment that addresses those needs.

All references cited and/or identified herein are specifically incorporated by reference herein.

SUMMARY OF THE INVENTION

One aspect of this invention entails a dispensing closure system for a flexible package holding a flowable product. The package, e.g., a pouch, has a wall portion including an openable port (e.g., a perforated or otherwise weakened portion of the wall of the package) to the interior of the package. The dispensing closure system comprises a body member, a resilient dispensing valve, and retainer assembly. The body member is arranged to be fixedly secured to the wall of the package, whereupon the cylindrical sidewall encircles the openable port. The resilient dispensing valve is located within the sidewall and held in place by the retainer assembly. The retainer assembly comprises a retaining member and a cap integrally connected to each other by a frangible connection. The retaining member is arranged to engage an interior portion of the sidewall to hold the resilient dispensing valve in place over the openable port, with the cap being disposed over and covering the resilient dispensing valve. The cap includes a first portion, (e.g., a ring-like handle) which may be grasped to break the frangible connection and thereby remove the cap from the retaining member to expose the resilient dispensing valve. The resilient dispensing valve is openable to enable a dispensing probe to be extended therethrough and through the openable port into the interior of the package to enable the product in the package to be dispensed therefrom.

Another aspect of this invention entails a package have the dispensing closure system such as described above.

Still another aspect of this invention entails a method of forming, filling and sealing a flexible package with a flowable product. The method may be conducted under aseptic conditions and comprises forming a package having a hollow interior from a flexible sheet material on a form, fill and seal machine. The package comprises a wall portion including an openable port to the interior of the package. The interior of the package is filled with the flowable product before sealing the package. The openable port is initially closed to prevent the egress of the flowable product therethrough when the package is filled and sealed. A dispensing closure system is provided for the package. The dispensing closure system comprises a hollow body member, a resilient dispensing valve, and retainer assembly. The retainer assembly comprises a retaining member (e.g., a ring) and a cap integrally connected to each other by a frangible connection. The retaining member holds the resilient dispensing valve in the hollow body with the cap being disposed over and covering the resilient dispensing valve. The cap includes a first portion (e.g., a ring-like handle) which may be grasped to break the frangible connection and thereby remove the cap from the retaining member to expose the resilient dispensing valve. The dispensing closure system is secured to the wall of the package, whereupon the hollow body member encircles the openable port and the resilient dispensing valve is disposed over the openable port, with the cap isolating the resilient dispensing valve from the ambient atmosphere.

Packages constructed in accordance with this invention may be utilized to dispense their flowable contents by grasping the first portion of the cap to break the frangible connection so that the cap can be removed from the retaining member to expose the resilient dispensing valve. A dispensing probe (or other tubular member) can then be extended through the resilient dispensing valve and into engagement with the openable port in the wall of the package to cause that port to open, whereupon the dispensing probe can pass therethrough into the interior of the package. The flowable material can then be made to flow out of the package through the dispensing probe.

DETAILED DESCRIPTION OF THE PREFERRED EMBODIMENT

Figure 1:
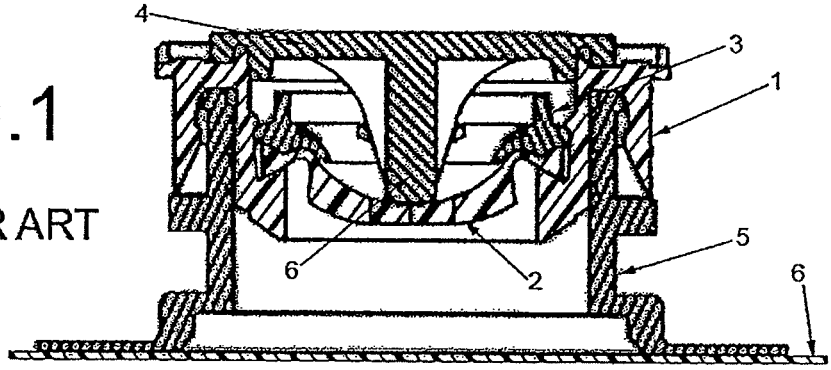
Fig.1 PRIOR ART
FIG. 1 is a vertical sectional view of a prior art fitment developed by the assignee of this invention for use with a flexible package for enabling the filling of the package with a flowable material through the fitment and for enabling the dispensing of the flowable material from the package through the fitment.

Referring now to the various figures of the drawing wherein like reference characters refer to like parts, there is shown in FIG. 1 an exemplary embodiment of a fitment in the form of a closure system for a package constructed in accordance with this invention. The closure system 20 is arranged to be secured to a flexible package, e.g., bag or pouch, that is formed, filled and sealed on a form-fill-seal machine, whereupon the filling of the package is not accomplished through the closure system. The subject closure system is particularly suited for use under aseptic conditions to allow a sterile, flowable product to be filled into the interior of the package via the form-fill-seal machine. One particularly suitable machine for this purpose is the GL-90 machine sold by Fresco System USA, Inc. Since the closure systems of this invention need not serve the purpose of providing a filling conduit for product entry, they can be specifically designed for the purpose of protecting the product and for the purpose of allow connection to a dispensing system, as will be described shortly.

Figure 6A:
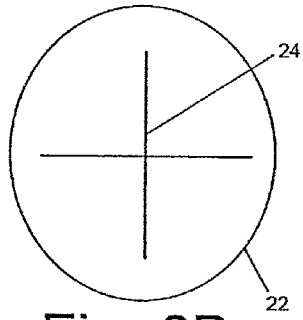
FIGS. 6A-6C are respective slightly enlarged top plan views taken along line 6A-C of FIG. 5 showing a portion of the wall of three embodiments of a flexible package to which a fitment constructed in accordance with this invention is secured.
Figure 6B:
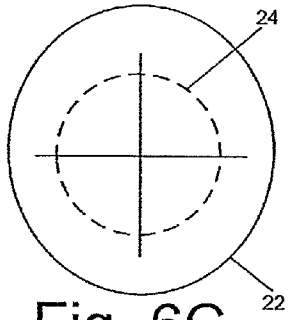
Figure 6C:
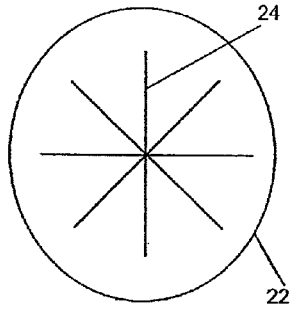

The fitment 20 is arranged to be secured onto an exterior portion of the wall 22 of a package formed, filled and sealed on a form-fill-seal machine (not shown). Before describing the details of the construction and operation of the fitment 20, a brief description of the flexible package is in order. To that end, the wall of the package can be formed of any suitable flexible material, e.g., a film, having one or more plies or layers of one or more types of materials, e.g., plastics, foils, etc. An openable port 24 is provided in one of the walls of the package. The fitment 20 is arranged to be secured to a portion of the wall of the package which includes the openable port 24 since it will be through that port that the contents of the package are accessed for dispensing. Three exemplary embodiments of a myriad of possible embodiments of an openable port 24 are shown in FIGS. 6A, 6B and 6C. Each includes a weakened or frangible line, which when the tip of a dispensing probe (to be described later) is brought into engagement with it break so that the probe can pass therethrough into the interior of the package where the flowable material is located. In the embodiment shown in FIG. 6A the openable port 24 is of a cruciform shape. In the embodiment of FIG. 6B the openable port 24 is of a circular shape. In the embodiment of FIG. 6C the openable port 24 is of a starburst-like shape.

Figure 2:
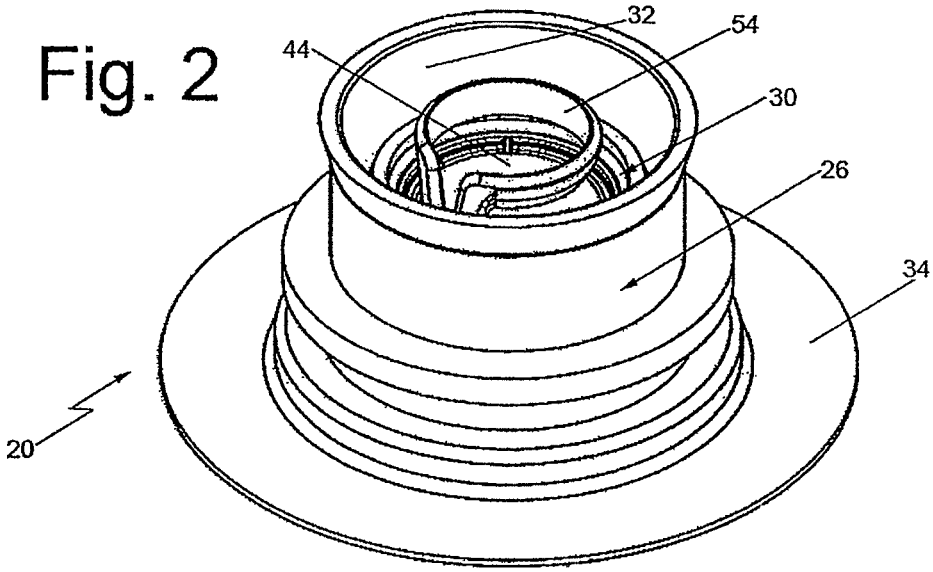
FIG. 2 is an isometric view of one exemplary fitment constructed in accordance with this invention which may be used on a flexible package produced, filled and sealed on a form, fill and seal machine.
Figure 3:
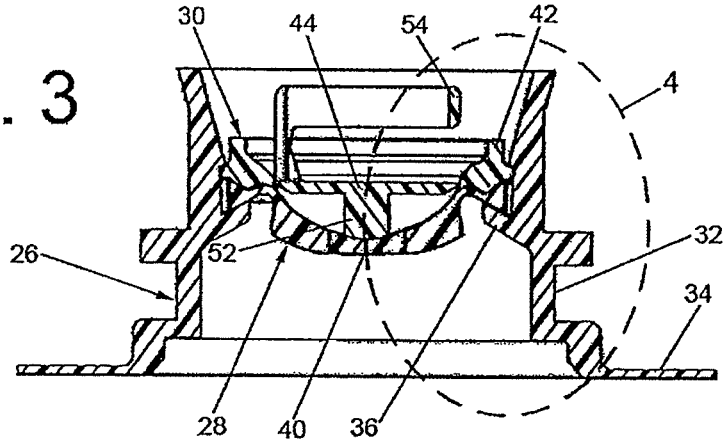
FIG. 3 is a vertical sectional view showing the fitment shown in FIG. 2.
Figure 4:
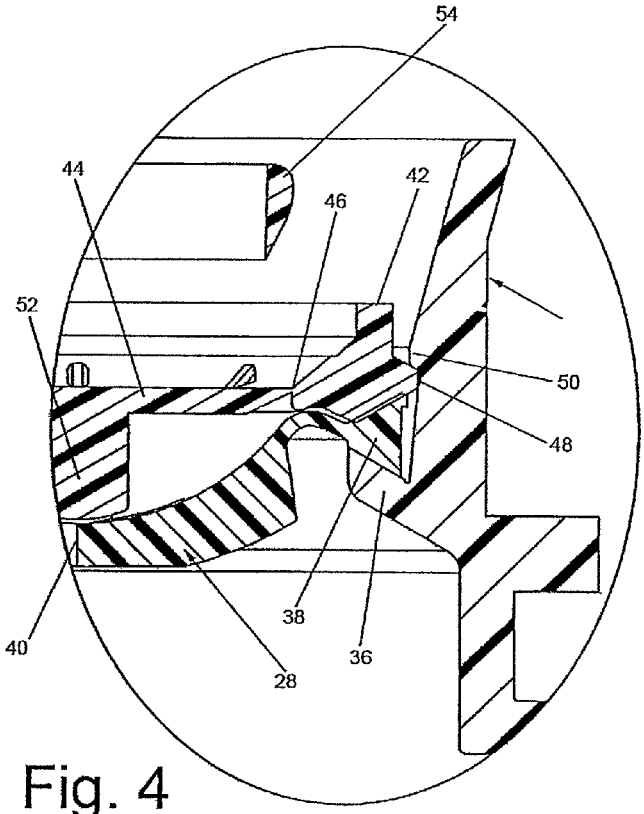
FIG. 4 is a greatly enlarged sectional view of the portion of the fitment shown within the oval designated as 4 in FIG. 3.

Turning now to FIGS. 2-4 the details of the dispensing closure system or fitment 20 will now be described. The fitment 20 basically comprises a body member 26, a resilient dispensing valve 28, and retainer assembly 30. The body member is a spout-like member that includes a hollow cylindrical, e.g., circular, sidewall 32, a peripheral annular flange 34 and an internal ledge 36. The peripheral flange is arranged to be fixedly secured, e.g., thermally bonded, to the outer surface of the wall 22 of the package, whereupon the cylindrical sidewall encircles the openable port 24. The ledge 36 is an annular member which extends radially inward from the inner surface of the sidewall 32 and is angled slightly upward as best seen in FIGS. 3 and 4. The ledge 36 serves as the seat for the resilient dispensing valve 28. That valve is preferably a slit-valve like those described above and is formed of any suitable resilient material, e.g., silicone. The valve includes a circular peripheral portion 38 arranged to be disposed on the top surface of the ledge 36. The central portion of the valve 28 includes a plurality of slits 40 whose edges normally abut each other to keep the valve closed. The slits 40 are centered over the openable port 24 in the wall 22 of the package.

In order to hold the resilient valve 28 in place and provide a bias to it so that its slits 40 remain closed the heretofore identified retainer assembly 30 is provided. That assembly is preferably an integrally molded unit that basically comprises a retaining ring 42 and a cover or cap 44 connected to each other by a frangible connection (e.g., circular line) 46. The retaining ring portion of the assembly 30 is a ring-like member having an outer surface 48 that is arranged to be disposed (e.g., snap-fit) under a lip 50 extending slightly radially inward from the inner surface of the sidewall 32, whereupon the peripheral portion 38 of the valve 28 is tightly interposed between the retaining ring 42 and the ledge 36.

The cap 44 is a generally planar disk-like member of circular shape. The outer peripheral edge portion of the cap tapers downward in thickness in the outward radial directions, as best seen in FIG. 4, where it merges with the inner edge of the retaining ring 42. That tapered peripheral portion of the cap 44 forms the heretofore identified frangible connection or line 46. The undersurface of the cap 44 includes a downward projection or post 52 which is arranged to engage portions of the valve 28 contiguous with the slits to act as a stop to prevent the slits from accidentally opening so as to preclude seepage or leakage through the valve (as will be described later). A ring-like handle 54 projects upward from the outer (top) surface of the cap 44. This handle enables the user of the package to pull on it to break the frangible connection 46 to remove the cap 44 from the retaining ring 42 to expose the underlying resilient valve 28 when it is desired to dispense the contents of the package through the fitment.

Figure 5:
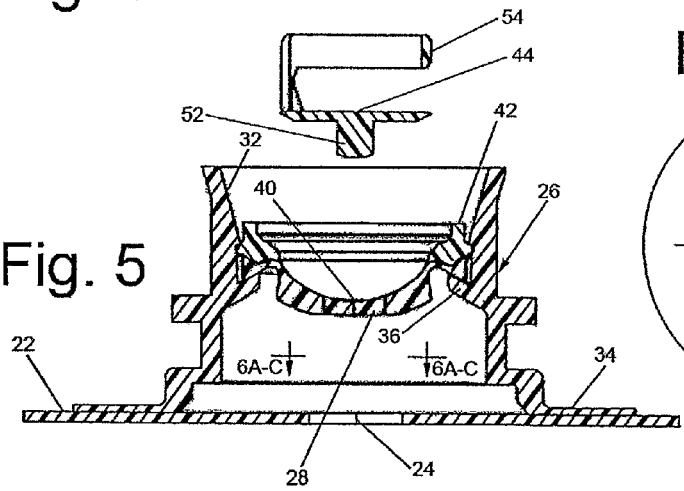
FIG. 5 is a vertical sectional view, similar to FIG. 3, but showing the exemplary fitment of this invention secured to a flexible package produced on a form, fill and seal machine, with a portion of the fitment shown in the process of being removed to provide access to the interior of the package by a dispensing probe.
Figure 7:
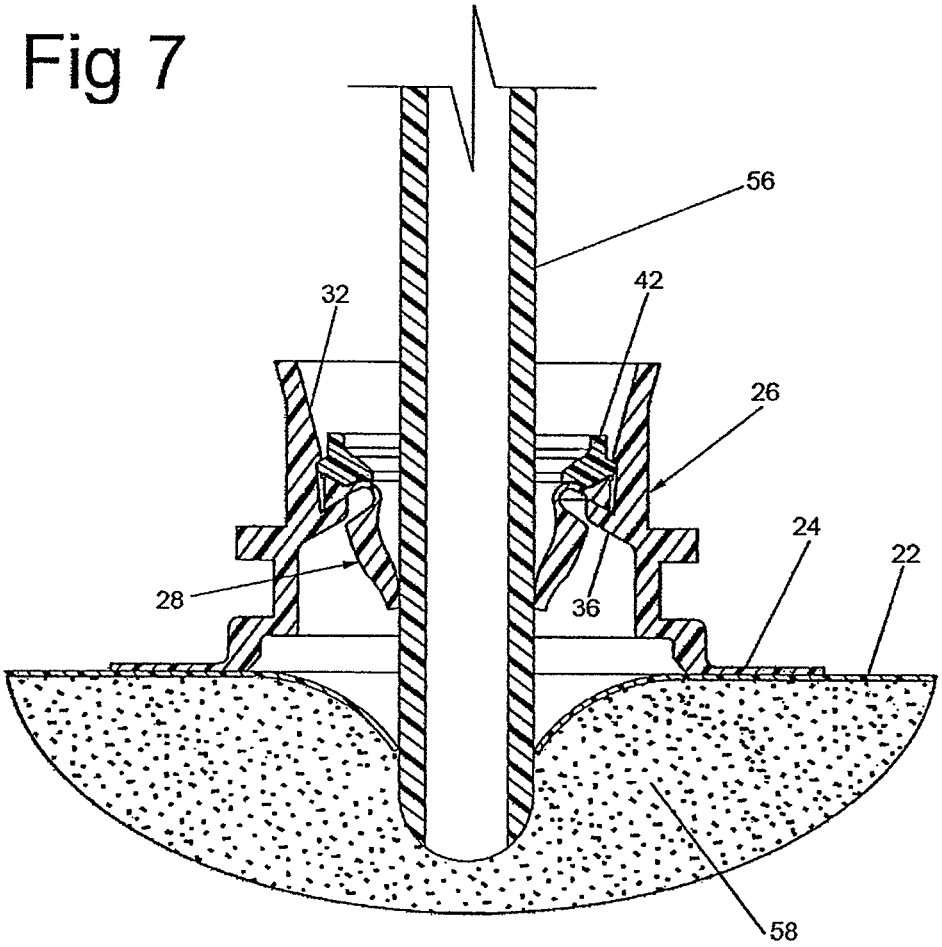
FIG. 7 is a vertical sectional view, similar to FIG. 5, but showing a flexible package with a fitment constructed in accordance with this invention in the process of having its flowable contents dispensed through a dispensing probe extending through the fitment.

The use of the package 20 to dispense its contents will now be described with reference to FIGS. 5 and 7. Thus, when it is desired to dispense some of the contents of the package 20 all that the user of the package has to do is to grasp and pull on the handle 54 to break the frangible connection 46, whereupon the cap 44 can be removed from the retaining ring 42 as best shown in FIG. 5. Once that has been accomplished a tubular dispensing probe 56 can be inserted through the center of the retaining ring as shown in FIG. 7 to bear upon the center of the now exposed valve 28. Continued downward pressure on the probe causes its tip to deflect the center portion of the valve to cause its slits to open and for the contiguous portion of the valve to tightly engage the periphery of the probe. Further continued downward pressure on the probe causes its tip to engage the wall 22 of the package at the openable port 24, thereby breaking the weakened lines thereat so that the tip of the probe can then pass into the interior of the package where the flowable product 58 is located. The flowable product may then be dispensed through the probe. The shape and construction of the valve ensures that while the probe extends through it there is no leakage or seepage of the flowable material through the interface between the valve and the probe.

As should be appreciated from the foregoing, because the fitment 20 of this invention need not include a means to effect the filling of the package though the fitment the molded slit valve 28 can be retained within the main body of what is in effect the spout portion of the fitment. Further, the retaining ring 42 which applies circumferential force to both hold and provide sealing pressure to the slit valve sealing surface is designed to include a means of access for the end user of the package. In particular, the retainer assembly 30 is preferably molded with a "tear-out" section, i.e., the cap 44, and a means of grasping it, i.e., the handle 54, to tear out this circular section. This construction creates several improvements over existing Bag-in-Box fitment assemblies. For example, because the retaining ring and tear out access cap are molded as in integral component and are connected to each other by a frangible connection, e.g., line 46, the assembly 30 will create a hermetic seal which eliminates the need for an addition safety cover over the spout portion (i.e., body 26) of fitment assembly.

It should be pointed out at this juncture that while the exemplary disclosed embodiment of the fitment 20 of this invention includes a center support post 52 to ensure that the slits 40 in the valve remain closed to prevent leakage (seepage) therethrough, such an arrangement is not mandatory. In fact, it is contemplated that the center support post of the cap 44 can be eliminated altogether from the fitment 20, given that the combination of the cap 44 and the retaining ring 42, itself, serves as the hermetic barrier to both internal pressures and to the ambient atmosphere.

It should also be noted that the method by which packages incorporating the fitment of this invention are produced also constitutes another aspect of this invention (as does the method of removing the contents of the package). With respect to the former, because the aseptic form-fill-seal machine produces packages with film that has been rendered commercially sterile the fitment assembly of this invention can be applied (heat sealed) to the film in line. Further, the fitment's construction lends itself to be sterilized from the back side (i.e., its flange side) prior to sealing it to the outer surface of a portion of the wall of the pouch or bag. To that end, it is envisioned that prior to sealing the fitment to the sterile pouch material that the film making up the pouch would be pre-cut, or pre-slit such that the film section directly beneath the fitment would open to the sterilized internal section of the fitment. Some examples of such pre-cuts are shown in FIGS. 6A-6C.

Without further elaboration the foregoing will so fully illustrate my invention that others may, by applying current or future knowledge, adopt the same for use under various conditions of service.

I claim:

1. A dispensing closure system for a flexible package holding a flowable product, the package having a wall portion including an openable port to the interior of the package, said dispensing closure system comprising an integral body member, a resilient dispensing valve, and retainer assembly, said body member comprising a hollow sidewall and a flange projecting outward from said sidewall, said sidewall having a top edge, said flange being arranged to be fixedly secured to the wall of the package, whereupon said sidewall encircles the openable port, said resilient dispensing valve including at least one openable slit to enable a dispensing probe to be extended therethrough, said resilient dispensing valve and said retainer assembly being located completely within said sidewall, said resilient dispensing valve being held in place by said retainer assembly, said retainer assembly comprising a retaining member and a cap integrally connected to each other by a frangible connection, said cap being removable from said retaining member and comprising a first portion disposed over said resilient dispensing valve, a first projection extending downward from said first portion of said cap into engagement with a portion of said resilient dispensing valve adjacent said at least one openable slit, and a grasping member projecting upward from said first portion of said cap but recessed from said top edge of said sidewall, said retaining member being arranged to engage an interior portion of said sidewall to hold said resilient dispensing valve in place over the openable port with said cap being disposed over and covering said resilient dispensing valve, said grasping member being arranged to be grasped to break said frangible connection and thereby remove said cap from said retaining member to expose said resilient dispensing valve, said resilient dispensing valve being openable to enable a dispensing probe to be extended therethrough and through the openable port into the interior of the package to enable the product in said package to be dispensed therefrom.

2. The dispensing closure system of claim 1 wherein said body member comprises a cylindrical sidewall and a peripheral flange, said peripheral flange being arranged to be fixedly secured to the wall of the package, whereupon said cylindrical sidewall encircles the openable port.

3. The dispensing closure system of claim 2 wherein said body member additionally comprises an internal ledge located within said cylindrical sidewall and arranged for supporting said resilient dispensing valve thereon over the openable port.

4. The dispensing closure system of claim 3 wherein said retaining member comprises a ring and wherein said retaining ring is arranged to engage an interior portion of said cylindrical sidewall to hold a portion of said resilient dispensing valve between it and said annular ledge with said cap being disposed over and covering said resilient valve.

5. The dispensing closure system of claim 1 wherein said retaining member and said cap are formed as an integrally molded member.

6. The dispensing closure system of claim 5 wherein said first portion of said cap comprises a ring-like handle.

7. The dispensing closure system of claim 6 wherein said ring-like handle projects upward from said cap.

8. A flexible package including an interior for holding a flowable product, said package comprising a wall portion including an openable port to said interior of the package and a dispensing closure system located at said openable port, said package arranged for holding a flowable material within said interior, said dispensing closure system comprising an integral body member, a resilient dispensing valve, and retainer assembly, said body member comprising a hollow sidewall and a flange projecting outward from said sidewall, said sidewall having a top edge, said flange being arranged to be fixedly secured to said wall of said package, whereupon said sidewall encircles said openable port, said resilient dispensing valve including at least one openable slit to enable a dispensing probe to be extended therethrough, said resilient dispensing valve and said retainer assembly being located completely within said sidewall, said resilient dispensing valve being held in place by said retainer assembly, said retainer assembly comprising a retaining member and a cap integrally connected to each other by a frangible connection, said cap being removable from said retaining member and comprising a first portion disposed over said resilient dispensing valve, a first projection extending downward from said first portion of said cap into engagement with a portion of said resilient dispensing valve adjacent said at least one openable slit, and a grasping member projecting upward from said first portion of said cap but recessed from said top edge of said sidewall, said retaining member being arranged to engage an interior portion of said sidewall to hold said resilient dispensing valve in place over the openable port with said cap being disposed over and covering said resilient valve, said grasping member being arranged to be grasped to break said frangible connection and thereby remove said cap from said retaining member to expose said resilient dispensing valve, said resilient dispensing valve being openable to enable a dispensing probe to be extended therethrough and through the openable port into the interior of the package to enable the flowable product in said package to be dispensed therefrom.

9. The package of claim 8 wherein said openable port comprises a frangible portion of said wall of said package.

10. The package of claim 8 wherein said body member comprises a cylindrical sidewall and a peripheral flange, said peripheral flange being arranged to be fixedly secured to the wall of the package, whereupon said cylindrical sidewall encircles the openable port.

11. The package of claim 10 wherein said body member additionally comprises an internal ledge located within said cylindrical sidewall and arranged for supporting said resilient dispensing valve thereon over the openable port.

12. The package of claim 11 wherein said retaining member comprises a ring and wherein said retaining ring is arranged to engage an interior portion of said cylindrical sidewall to hold a portion of said resilient dispensing valve between it and said annular ledge with said cap being disposed over and covering said resilient valve.

13. The package of claim 8 wherein said retaining member and said cap are formed as an integrally molded member.

14. The package of claim 13 wherein said first portion of said cap comprises a ring-like handle.

15. The package of claim 14 wherein said ring-like handle projects upward from said cap.

16. A method of forming, filling and sealing a flexible package with a flowable product, said method comprising:

forming a package having a hollow interior from a flexible sheet material on a form, fill and seal machine, said package comprising a wall portion including an openable port to the interior of said package, said interior of said package being filled with said flowable product, said openable port being initially closed to prevent the egress of the flowable product therethrough;

providing a dispensing closure system comprising an integral body member, a resilient dispensing valve, and retainer assembly, said resilient dispensing valve including at least one openable slit to enable a dispensing probe to be extended therethrough, said body member comprising a hollow sidewall and a flange projecting outward from said sidewall, said sidewall having a top edge, said resilient dispensing valve and said retainer assembly being located completely within said sidewall, said retainer assembly comprising a retaining ring and a cap integrally connected to each other by a frangible connection, said cap being removable from said retaining member and comprising a first portion disposed over said resilient dispensing valve, a first projection extending downward from said first portion of said cap into engagement with a portion of said resilient dispensing valve adjacent said at least one openable slit, and a grasping member projecting upward from said first portion of said cap but recessed from said top edge of said sidewall, said retaining member engaging an interior portion of said sidewall to hold said resilient dispensing valve in place within said sidewall with said cap being disposed over and covering said resilient dispensing valve, said grasping member being arranged to be grasped to break said frangible connection and thereby remove said cap from said retaining ring to expose said resilient dispensing valve; and securing said flange of said body member to said wall of said package, whereupon said sidewall encircles said openable port and said resilient valve is disposed over said openable port, with said cap isolating said resilient valve from the ambient atmosphere.

17. The method of claim 16 wherein said package is filled with a flowable material under aseptic conditions, and wherein said dispensing closure system is sterilized and secured to the wall of said package over said openable port under aseptic conditions.

18. The method of claim 16 wherein said openable port comprises a frangible portion of said wall of said package.

19. The method of claim 16 wherein said package is filled with a flowable material under aseptic conditions, and wherein said dispensing closure system is sterilized and secured to the wall of said package over said openable port under aseptic conditions.

20. A method of dispensing a flowable material comprising:

providing a package having a hollow interior formed from a flexible sheet material on a form, fill and seal machine, said package comprising a dispensing closure system and a wall portion including an openable port to the interior of said package, said interior of said package being filled with said flowable product, said openable port being initially closed to prevent the egress of the flowable product therethrough, said dispensing closure system comprising an integral body member, a resilient dispensing valve including at least one openable slit to enable a dispensing probe to be extended therethrough, said body member comprising a hollow sidewall and a flange projecting outward from said sidewall, said sidewall having a top edge, said resilient dispensing valve and said retainer assembly being located completely within said sidewall, said retainer assembly comprising a retaining ring and a cap integrally connected to each other by a frangible connection, said cap being removable from said retaining member and comprising a first portion disposed over said resilient dispensing valve, a first projection extending downward from said first portion of said cap into engagement with a portion of said resilient dispensing valve adjacent said at least one openable slit, and a grasping member projecting upward from said first portion of said cap but recessed from said top edge of said sidewall, said retaining member engaging an interior portion of said sidewall to hold said resilient dispensing valve in place within said sidewall with said cap being disposed over and covering said resilient dispensing valve, said grasping member being arranged to be grasped to break said frangible connection and thereby remove said cap from said retaining ring to expose said resilient dispensing valve, said flange of said body member being secured to said wall of said package with said sidewall and encircling said openable port, with said cap being disposed completely within said hollow body over and covering said resilient valve to isolate said resilient valve from the ambient atmosphere;

reaching into said hollow body to grasp said grasping member of said cap and pulling thereon and break said frangible connection;

removing said cap from said retaining ring to expose said resilient dispensing valve; and introducing a tubular dispensing probe through said resilient dispensing valve and into engagement with said openable port in said wall of said package to cause said port to open, whereupon the tubular dispensing probe can pass therethrough into said interior of said package to enable the flowable product to be dispensed from said package.

* * * * *